US011015828B2

(12) United States Patent
Sakae et al.

(10) Patent No.: US 11,015,828 B2
(45) Date of Patent: May 25, 2021

(54) REFRIGERATION SYSTEM WITH UTILIZATION UNIT LEAK DETECTION

(71) Applicant: DAIKIN INDUSTRIES, LTD., Osaka (JP)

(72) Inventors: Satoru Sakae, Osaka (JP); Azuma Kondou, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 106 days.

(21) Appl. No.: 16/317,330

(22) PCT Filed: Jul. 11, 2017

(86) PCT No.: PCT/JP2017/025241
§ 371 (c)(1),
(2) Date: Jan. 11, 2019

(87) PCT Pub. No.: WO2018/012489
PCT Pub. Date: Jan. 18, 2018

(65) Prior Publication Data

US 2019/0226705 A1 Jul. 25, 2019

(30) Foreign Application Priority Data

Jul. 15, 2016 (JP) ..... JP2016-140612

(51) Int. Cl.
*F25B 49/02* (2006.01)
*F24F 11/36* (2018.01)
(Continued)

(52) U.S. Cl.
CPC ..... *F24F 11/36* (2018.01); *F25B 1/00* (2013.01); *F25B 49/005* (2013.01); *F25B 49/02* (2013.01);
(Continued)

(58) Field of Classification Search
CPC ..... F24F 11/32; F24F 11/36; F25B 49/005; F25B 2500/22; F25B 2500/222; F25B 2700/197
See application file for complete search history.

(56) References Cited

U.S. PATENT DOCUMENTS 5,709,097 A 1/1998 Kim et al.
2003/0213254 A1 11/2003 Koo
(Continued)

FOREIGN PATENT DOCUMENTS

CN 1514178 A 7/2004
CN 101283243 A 10/2008
(Continued)

OTHER PUBLICATIONS

JP 2005-241050 (English Translation) (Year: 2005).*
(Continued)

*Primary Examiner* — Jonathan Bradford
(74) *Attorney, Agent, or Firm* — Birch, Stewart, Kolasch & Birch, LLP

(57) ABSTRACT

A refrigeration system includes a plurality of utilization units provided for one air conditioning target space, a refrigerant leakage sensor that detects a leakage of the refrigerant in a lower part of the air conditioning target space, and a control unit. In a case where the refrigerant leakage sensor detects the refrigerant leakage, the control unit performs detection standby control on the utilization units such that the supply of the refrigerant to utilization-side heat exchangers is temporarily stopped. In a case where the refrigerant leakage is detected based on the state quantity of the refrigerant corresponding to the utilization units under the detection standby control, the control unit stops the use of the utilization unit in which the refrigerant leakage has been detected.

10 Claims, 7 Drawing Sheets

(51) Int. Cl.

| | |
|---|---|
| ***F25B 1/00*** | (2006.01) |
| ***F25B 49/00*** | (2006.01) |
| *F25B 5/02* | (2006.01) |
| *F24F 140/00* | (2018.01) |

(52) U.S. Cl.
CPC ..... *F24F 2140/00* (2018.01); *F25B 5/02* (2013.01); *F25B 2500/222* (2013.01); *F25B 2600/05* (2013.01); *F25B 2600/2515* (2013.01); *F25B 2700/04* (2013.01); *F25B 2700/197* (2013.01)

(56) References Cited

U.S. PATENT DOCUMENTS

| | | | | |
|---|---|---|---|---|
| 2005/0103029 | A1* | 5/2005 | Kawahara | F25D 29/008 62/126 |
| 2009/0084119 | A1 | 4/2009 | Lifson et al. | |
| 2012/0272672 | A1 | 11/2012 | Morimoto et al. | |
| 2017/0198946 | A1* | 7/2017 | Takenaka | F24F 11/89 |
| 2018/0045424 | A1* | 2/2018 | Yajima | F24F 11/30 |

FOREIGN PATENT DOCUMENTS

| | | | |
|---|---|---|---|
| JP | 5-118720 | A | 5/1993 |
| JP | 2005-241050 | A | 9/2005 |
| JP | 2010-79998 | A | 5/2010 |
| JP | 4639451 | B2 | 2/2011 |
| JP | 2013-40694 | A | 2/2013 |
| JP | 2016-17643 | A | 2/2016 |
| WO | WO 2011/099063 | A1 | 8/2011 |
| WO | WO 2016/017643 | A1 | 2/2016 |

OTHER PUBLICATIONS

International Preliminary Report on Patentability and Written Opinion of the International Searching Authority for International Application No. PCT/JP2017/025241, dated Jan. 24, 2019, with English translation.
International Search Report, issued in PCT/JP2017/025241, PCT/ISA/210, dated Oct. 3, 2017.
Extended European Search Report, dated Feb. 13, 2020, for European Application No. 17827616.8.

* cited by examiner

REFRIGERATION SYSTEM WITH UTILIZATION UNIT LEAK DETECTION

TECHNICAL FIELD

The present invention relates to a refrigeration system, and particularly to a refrigeration system provided with a plurality of utilization units for one air conditioning target space.

BACKGROUND ART

As disclosed in Patent Literature 1 (JP 2013-40694 A), there is conventionally a refrigeration apparatus (refrigeration system) provided with a plurality of indoor units (utilization units) for one air conditioning target space such as a large refrigeration warehouse or freezer warehouse. Each utilization unit has an indoor heat exchanger (utilization-side heat exchanger) for exchanging heat between a refrigerant and air.

As disclosed in Patent Literature 2 (JP 4639451 B2), there is an air conditioner in which an indoor unit (utilization unit) is provided with a refrigerant leakage sensor in a case where a flammable refrigerant is used. In this air conditioner, when the refrigerant leakage sensor detects a leakage of the refrigerant, the use of the utilization unit is stopped.

SUMMARY OF THE INVENTION

The following may be considered also for the refrigeration system of Patent Literature 1 mentioned above. That is, in a case where the flammable refrigerant is used, a refrigerant leakage sensor similar to the one disclosed in Patent Literature 2 mentioned above is provided as a safety measure. When the refrigerant leakage sensor detects the refrigerant leakage, the use of the utilization unit is stopped. Here, in the refrigeration system of Patent Literature 1, the refrigerant leaked in the utilization unit tends to accumulate in a lower part of the air conditioning target space. For this reason, the refrigeration system of Patent Literature 1 needs to include the refrigerant leakage sensor at the lower part of the air conditioning target space.

However, the refrigeration system of Patent Literature 1 includes a plurality of utilization units for one air conditioning target space. Therefore, if the refrigerant leakage sensor provided at the lower part of the air conditioning target space detects the refrigerant leakage, it is impossible to determine in which utilization unit the refrigerant leakage has occurred. For this reason, in a case where the refrigerant leakage is detected, it is necessary to stop using all the utilization units. This makes it difficult to maintain the temperature of the air conditioning target space such as a refrigeration warehouse and a freezer warehouse, in a case where it is necessary to maintain the temperature of articles stored in the air conditioning target space.

An object of the present invention is to maintain the temperature of one air conditioning target space as much as possible while minimizing a refrigerant leakage in a refrigeration system provided with a plurality of utilization units for the air conditioning target space.

A refrigeration system according to a first aspect includes a plurality of utilization units provided for one air conditioning target space, a refrigerant leakage sensor, and a control unit. Each of the utilization units includes a utilization-side heat exchanger that exchanges heat between a refrigerant and air. The refrigerant leakage sensor detects a leakage of the refrigerant in a lower part of the air conditioning target space. In a case where the refrigerant leakage sensor detects the refrigerant leakage, the control unit performs detection standby control on the utilization units such that the supply of the refrigerant to the utilization-side heat exchangers is temporarily stopped. In a case where the refrigerant leakage is detected based on a state quantity of the refrigerant corresponding to the utilization units under the detection standby control, the control unit stops the use of the utilization unit in which the refrigerant leakage has been detected.

Here, when the refrigerant leakage sensor detects the refrigerant leakage in the air conditioning target space provided in common for the plurality of utilization units, the detection standby control mentioned above is performed first so that it becomes easy to notice a change in the state quantity of the refrigerant caused by the refrigerant leakage from the utilization unit. In the case where the refrigerant leakage is detected based on the state quantity of the refrigerant in the utilization units during the detection standby control, the use of the utilization unit in which the refrigerant leakage has been detected is stopped. This makes it possible to suppress the refrigerant leakage from the utilization unit, in which the refrigerant is leaking, to the air conditioning target space, and to continue the operation of the utilization unit in which the refrigerant is not leaking. The refrigerant leakage in the utilization unit is detected based on the state quantity of the refrigerant. Therefore, in a case where the refrigerant leakage is not detected in any of the utilization units during the detection standby control, it can be determined that the refrigerant leakage sensor has erroneously detected, for example, other flammable gas other than the refrigerant.

As a result, here, the refrigeration system provided with the plurality of utilization units for one air conditioning target space can reliably determine the utilization unit in which the refrigerant is leaking and stop the use of that utilization unit. This makes it possible to minimize the refrigerant leakage to the air conditioning target space and to continue the operation of the utilization unit in which the refrigerant is not leaking, thereby maintaining the temperature of the air conditioning target space as much as possible.

A refrigeration system according to a second aspect further includes a plurality of heat source units provided corresponding to the respective utilization units in the refrigeration system according to the first aspect. Each of the heat source units constitutes a corresponding refrigerant circuit through which the refrigerant circulates, by being connected to the corresponding utilization unit. In other words, here, each of the utilization units includes a refrigerant circuit.

Also in this case, as in the refrigeration system according to the first aspect, the refrigeration system can reliably determine the utilization unit in which the refrigerant is leaking and stop the use of that utilization unit. This makes it possible to minimize the refrigerant leakage to the air conditioning target space and to continue the operation of the utilization unit in which the refrigerant is not leaking, thereby maintaining the temperature of the air conditioning target space as much as possible.

A refrigeration system according to a third aspect is the refrigeration system according to the second aspect, wherein the control unit determines that the refrigerant leakage has been detected in a case where the state quantity of the refrigerant corresponding to the utilization units under the detection standby control indicates that any of the refrigerant circuits constituted by the corresponding utilization units has run out of gas.

The refrigerant circuit including the utilization unit in which the refrigerant is leaking runs out of gas due to the refrigerant leakage. Therefore, here, as described above, the refrigerant leakage is detected in a case where the state quantity of the refrigerant corresponding to the utilization units under the detection standby control indicates that any of the refrigerant circuits constituted by the corresponding utilization units has run out of gas. As a result, here, the utilization unit in which the refrigerant is leaking can be reliably determined based on the state quantity of the refrigerant corresponding to the utilization units under the detection standby control.

A refrigeration system according to a fourth aspect is the refrigeration system according to the second or third aspect, wherein when the control unit stops use of the utilization unit in which the refrigerant leakage has been detected, the control unit performs refrigerant recovery control for causing the heat source unit, which is connected to the utilization unit to be stopped, to recover the refrigerant.

Here, the refrigerant recovery control is performed at the time of stopping the use of the utilization unit in which the refrigerant leakage has been detected. It is thus possible to reduce the amount of refrigerant present in the utilization unit to be stopped. This makes it possible to further reduce the amount of refrigerant leaking from the utilization unit to be stopped to the air conditioning target space.

A refrigeration system according to a fifth aspect further includes a heat source unit provided in common for the plurality of utilization units in the refrigeration system according to the first aspect. The heat source unit is connected to the plurality of utilization units to thereby constitute a refrigerant circuit through which the refrigerant circulates. In other words, here, the refrigerant circuit is provided in common for the plurality of utilization units.

Also in this case, as in the refrigeration system according to the first aspect, the refrigeration system can reliably determine the utilization unit in which the refrigerant is leaking and stop the use of that utilization unit. This makes it possible to minimize the refrigerant leakage to the air conditioning target space and to continue the operation of the utilization unit in which the refrigerant is not leaking, thereby maintaining the temperature of the air conditioning target space as much as possible.

A refrigeration system according to a sixth aspect is the refrigeration system according to the fifth aspect, further including an inlet valve and an outlet valve on a refrigerant inlet side and a refrigerant outlet side, respectively, of each of the utilization-side heat exchangers. The control unit performs the detection standby control using the inlet valve and the outlet valve.

Here, as described above, the control unit performs the detection standby control using the inlet valve and the outlet valve provided on the refrigerant inlet side and the refrigerant outlet side, respectively, of the utilization-side heat exchanger. That is, the inlet valve and the outlet valve that are opened during the operation of the utilization unit are closed during the detection standby control, whereby the supply of the refrigerant to the utilization-side heat exchanger can temporarily be stopped. This surely makes it easy to notice a change in the state quantity of the refrigerant caused by the refrigerant leakage from the utilization unit.

A refrigeration system according to a seventh aspect is the refrigeration system according to the sixth aspect, wherein the control unit determines that the refrigerant leakage has been detected in a case where the state quantity of the refrigerant corresponding to the utilization units under the detection standby control indicates that a pressure of the refrigerant in the corresponding utilization-side heat exchanger is near an atmospheric pressure.

In the utilization unit in which the refrigerant is leaking, the pressure of the refrigerant in the utilization-side heat exchanger decreases to approach the atmospheric pressure due to the refrigerant leakage during the detection standby control. Therefore, here, as described above, the refrigerant leakage is detected in a case where the state quantity of the refrigerant corresponding to the utilization units under the detection standby control indicates that the pressure of the refrigerant in the corresponding utilization-side heat exchanger is near the atmospheric pressure. As a result, here, the utilization unit in which the refrigerant is leaking can be reliably determined based on the state quantity of the refrigerant corresponding to the utilization units under the detection standby control.

A refrigeration system according to an eighth aspect is the refrigeration system according to the sixth or seventh aspect, wherein when the control unit stops use of the utilization unit in which the refrigerant leakage has been detected, the control unit performs refrigerant shut-off control for shutting off flow of the refrigerant to the utilization-side heat exchanger of the utilization unit to be stopped, using the inlet valve and the outlet valve corresponding to that utilization-side heat exchanger.

Here, the refrigerant shut-off control is performed at the time of stopping the use of the utilization unit in which the refrigerant leakage has been detected. As a result, the section between the inlet valve and the outlet valve in the utilization unit to be stopped can be separated from the other section of the refrigerant circuit. This makes it possible to further reduce the amount of refrigerant leaking from the utilization unit to be stopped to the air conditioning target space.

DESCRIPTION OF EMBODIMENTS

Hereinafter, a refrigeration system according to an embodiment of the present invention will be described with reference to the drawings. A specific configuration of the refrigeration system according to the embodiment of the present invention is not limited to those in the following embodiments and modifications thereof, but can be modified within the scope not departing from the gist of the invention.

(1) First Embodiment

<Configuration>

Figure 1:
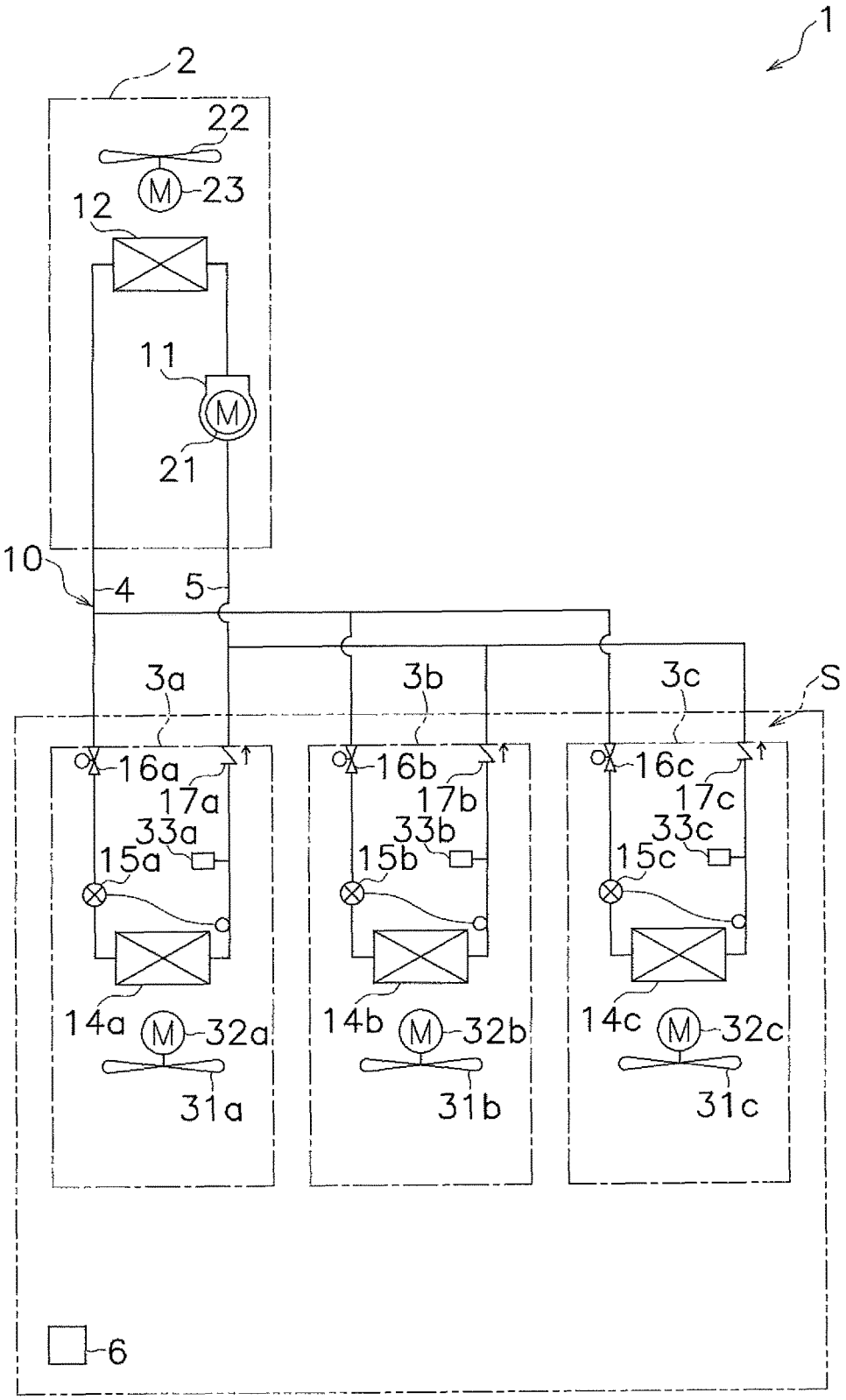
FIG. 1 is a schematic configuration diagram of a refrigeration system according to a first embodiment of the present invention.
Figure 2:
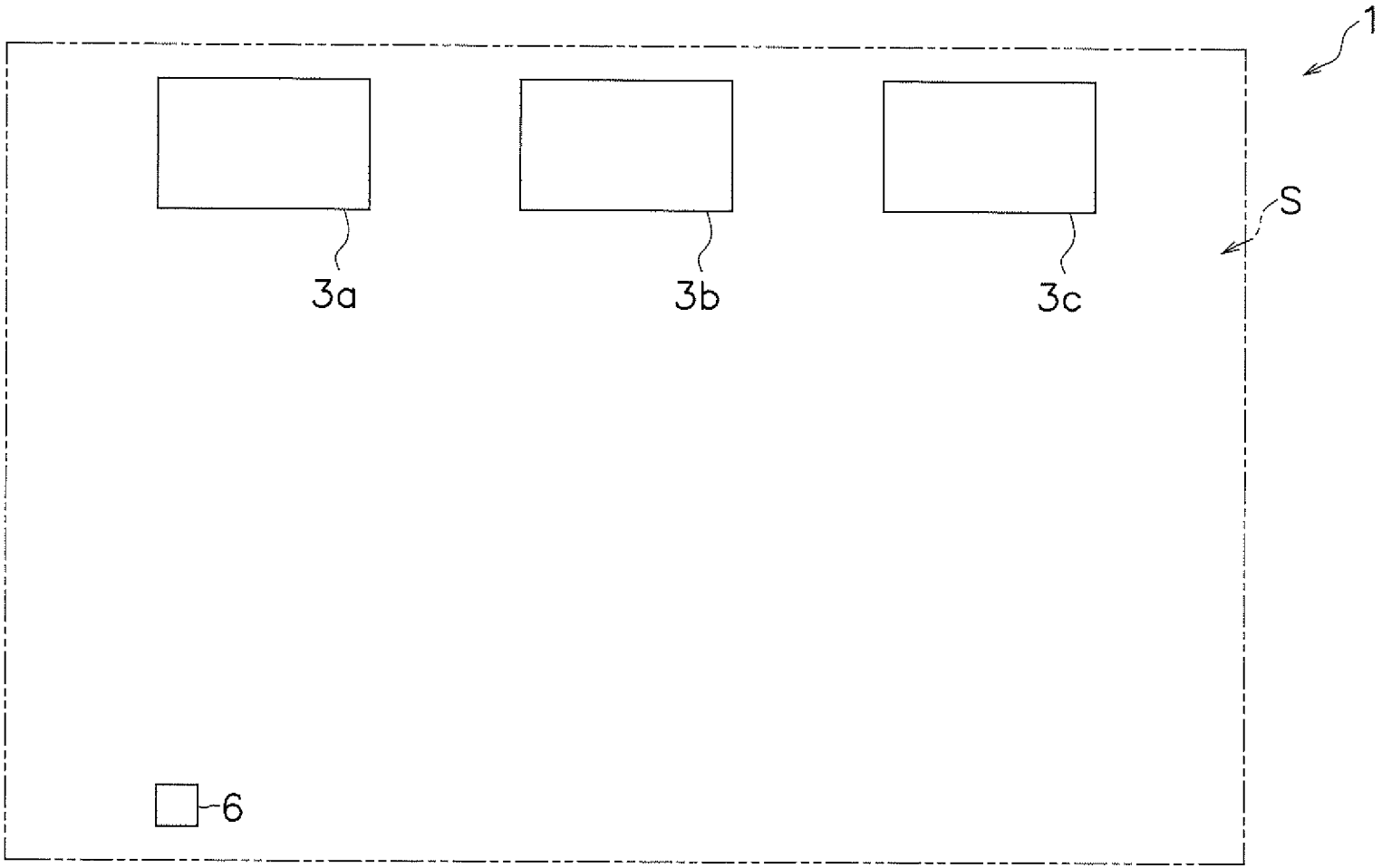
FIG. 2 is a schematic layout diagram of utilization units and a refrigerant leakage sensor that constitute the refrigeration system according to the first embodiment and a refrigeration system according to a second embodiment.

FIG. 1 is a schematic configuration diagram of a refrigeration system according to a first embodiment of the present invention. The refrigeration system 1 has a plurality of (in this case, three) utilization units 3*a*, 3*b*, and 3*c* provided for one air conditioning target space S such as a large refrigeration warehouse or freezer warehouse. As illustrated in FIG. 2, the utilization units 3*a*, 3*b*, and 3*c* are disposed at an upper part of the air conditioning target space S. The number of utilization units is not limited to three, and just needs to be two or more. Alternatively, the utilization units 3*a*, 3*b*, and 3*c* may be disposed above the air conditioning target space S.

Here, the refrigeration system 1 further includes a heat source unit 2 provided in common for the utilization units 3*a*, 3*b*, and 3*c*. As illustrated in FIG. 1, the heat source unit 2 is disposed outside the air conditioning target space S. The heat source unit 2 is connected to the plurality of utilization units 3*a*, 3*b*, and 3*c* to thereby constitute a refrigerant circuit 10 through which a refrigerant circulates. Here, the utilization units 3*a*, 3*b*, and 3*c* constitute the refrigerant circuit 10 by being connected to the heat source unit 2 via a liquid-refrigerant connection pipe 4 and a gas-refrigerant connection pipe 5. That is, here, the refrigerant circuit 10 is provided in common for the plurality of utilization units 3*a*, 3*b*, and 3*c* as described above. The refrigerant circuit 10 is filled with the refrigerant. In this case, the refrigerant used is R32, which is one kind of flammable refrigerant. The refrigerant to be charged into the refrigerant circuit 10 is not limited to R32 but may be other flammable refrigerant such as propane.

Next, the refrigerant circuit 10 and a peripheral configuration thereof will be described.

The refrigerant circuit 10 mainly includes a compressor 11, a heat source-side heat exchanger 12, inlet valves 16*a*, 16*b*, and 16*c*, utilization-side expansion valves 15*a*, 15*b*, and 15*c*, utilization-side heat exchangers 14*a*, 14*b*, and 14*c*, outlet valves 17*a*, 17*b*, and 17*c*, and refrigerant pipes (including the refrigerant connection pipes 4 and 5) that connect these devices. The inlet valves 16*a*, 16*b*, and 16*c*, the utilization-side expansion valves 15*a*, 15*b*, and 15*c*, the utilization-side heat exchangers 14*a*, 14*b*, and 14*c*, and the outlet valves 17*a*, 17*b*, and 17*c* are provided in the utilization units 3*a*, 3*b*, and 3*c*, respectively. In the following description, only the configurations provided in the utilization unit 3*a* will be described among the configurations in the utilization units 3*a*, 3*b*, and 3*c*. The description of the configurations provided in the utilization units 3*b* and 3*c* is omitted, since the suffix "a" just needs to be replaced with "b" or "c" for that matter.

The compressor 11 is a device that is provided in the heat source unit 2 and compresses low-pressure gas refrigerant until the gas refrigerant turns into high-pressure gas refrigerant. The compressor 11 is driven by a compressor motor 21.

The heat source-side heat exchanger 12 is a device that is provided in the heat source unit 2 and exchanges heat between the high-pressure gas refrigerant after being compressed in the compressor 11 and air outside the air conditioning target space S (outdoor air). That is, the heat source-side heat exchanger 12 functions as a refrigerant radiator that releases heat from the high-pressure gas refrigerant using outdoor air as a cooling source. A heat source-side fan 22 supplies the outdoor air to the heat source-side heat exchanger 12. The heat source-side fan 22 is provided in the heat source unit 2. The heat source-side fan 22 is driven by a heat source-side fan motor 23. Here, an air-cooled radiator using the outdoor air as a cooling source is adopted as the heat source-side heat exchanger 12, but the heat exchanger is not limited to such a radiator. Alternatively, a water-cooled radiator using water as a cooling source may be used.

As described above, the heat source unit 2 is mainly provided with the compressor 11 and the heat source-side heat exchanger 12. The heat source unit 2 functions as a condensing unit that converts low-pressure gas refrigerant into high-pressure liquid refrigerant.

The inlet valve 16*a* is a device that is provided in the utilization unit 3*a* and is capable of shutting off the flow of the high-pressure liquid refrigerant, from which heat has been released in the heat source-side heat exchanger 12, into the utilization unit 3*a* through the liquid-refrigerant connection pipe 4. The inlet valve 16*a* is provided on a refrigerant inlet side of the utilization-side heat exchanger 14*a*. In this case, an electromagnetic valve, opening and closing of which are controllable, is adopted as the inlet valve 16*a*, but the inlet valve is not limited to such a valve.

The utilization-side expansion valve 15*a* is a device that is provided in the utilization unit 3*a* and decompresses the high-pressure liquid refrigerant having passed through the inlet valve 16*a* until the liquid refrigerant turns into low-pressure liquid refrigerant. Here, a temperature-sensitive expansion valve including a temperature-sensitive part provided on the outlet side of the utilization-side heat exchanger 14*a* is adopted as the utilization-side expansion valve 15*a*, but the expansion valve is not limited to such a valve.

The utilization-side heat exchanger 14*a* is a device that is provided in the utilization unit 3*a* and exchanges heat between the low-pressure refrigerant after being decompressed in the utilization-side expansion valve 15*a* and air inside the air conditioning target space S (indoor air). That is, the utilization-side heat exchanger 14*a* functions as a refrigerant evaporator that evaporates the low-pressure refrigerant using the indoor air as a heating source. A utilization-side fan 31*a* supplies the indoor air to the utilization-side heat exchanger 14*a*. In other words, the utilization-side fan 31*a* is provided as a device that sends, to the air conditioning target space S, the indoor air with which heat has been exchanged in the utilization-side heat exchanger 14*a*. The utilization-side fan 31*a* is provided in the utilization unit 3*a*. The utilization-side fan 31*a* is driven by a utilization-side fan motor 32*a*.

The outlet valve 17*a* is a device that is provided in the utilization unit 3*a* and is capable of shutting off the flow of the refrigerant flowing backward from the gas-refrigerant connection pipe 5 to the utilization unit 3*a*. The outlet valve 17*a* is provided on a refrigerant outlet side of the utilization-side heat exchanger 14*a*. In this case, a check valve is adopted as the outlet valve 17*a*. The check valve here allows the refrigerant to flow from the outlet of the utilization-side heat exchanger 14*a* to the gas-refrigerant connection pipe 5 while shutting off the backflow of the refrigerant from the gas-refrigerant connection pipe 5 to the outlet of the utilization-side heat exchanger 14*a*. However, the outlet valve is not limited to such a valve.

A pressure sensor 33*a* is a device that is provided in the utilization unit 3*a* and detects a refrigerant pressure Px in the utilization-side heat exchanger 14*a*. The pressure sensor 33*a* is provided between the inlet valve 16*a* and the outlet valve 17*a*, more specifically between the utilization-side heat exchanger 14*a* and the outlet valve 17*a*.

In this manner, the utilization unit 3*a* is mainly provided with the inlet valve 16*a*, the utilization-side expansion valve 15*a*, the utilization-side heat exchanger 14*a*, the outlet valve 17*a*, the utilization-side fan 31*a*, and the pressure sensor 33*a*. The utilization unit 3*a* functions as a blower coil unit that cools the indoor air by evaporating the low-pressure refrigerant and sends the indoor air to the air conditioning target space S.

The refrigeration system 1 is also provided with a refrigerant leakage sensor 6 that detects a leakage of the refrigerant, as a safety measure against use of flammable refrigerant such as R32. The flammable refrigerant such as R32 is heavier than air. Therefore, when the refrigerant leaks in the utilization units 3*a*, 3*b*, and 3*c*, the leaked refrigerant tends to accumulate in a lower part of the air conditioning target space S below the utilization units 3*a*, 3*b*, and 3*c*. In consideration of this, the refrigerant leakage sensor 6 is provided in a lower part of the air conditioning target space S as illustrated in FIG. 2.

Figure 3:
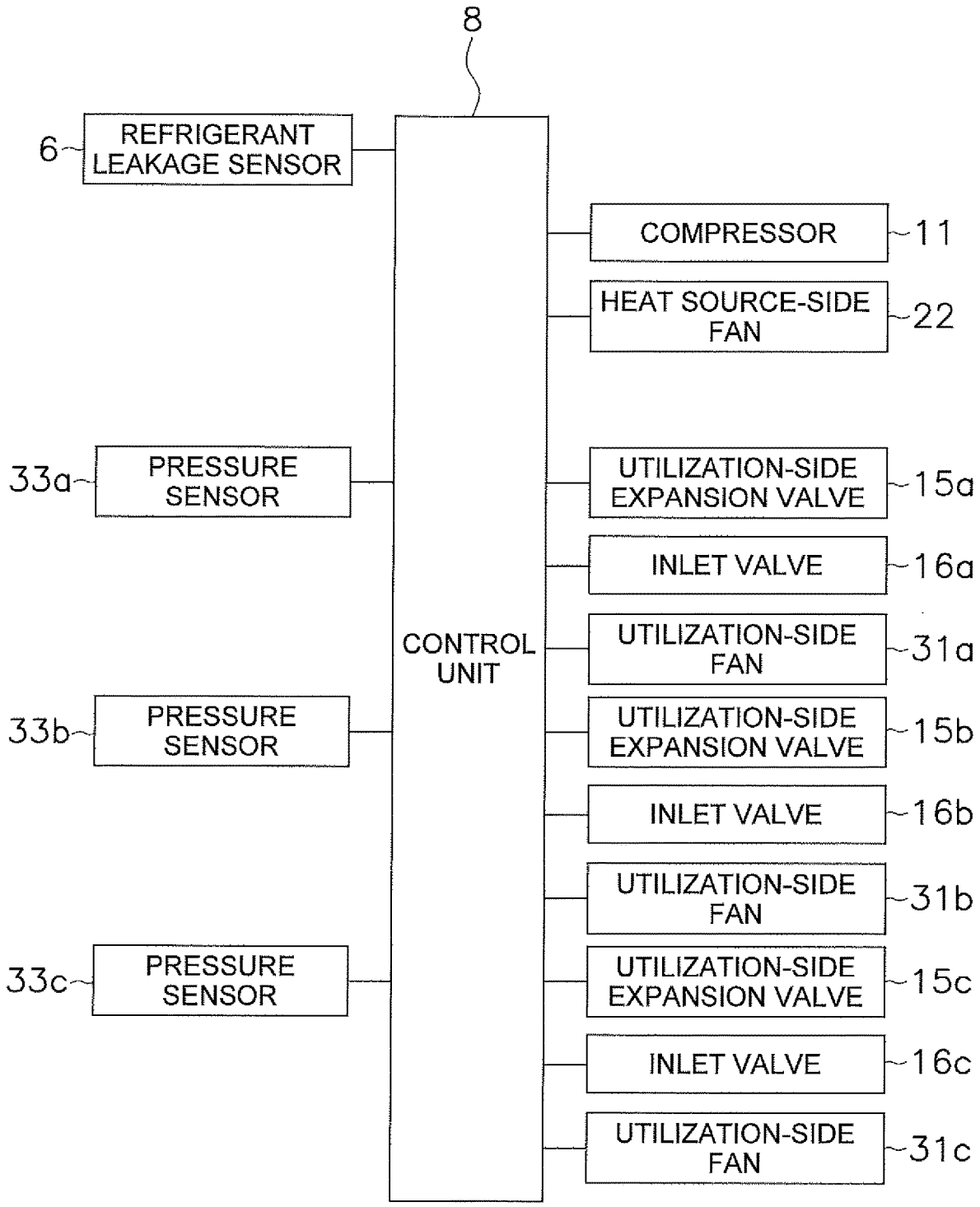
FIG. 3 is a control block diagram of the refrigeration system according to the first embodiment.

As illustrated in FIG. 3, the refrigeration system 1 is also provided with a control unit 8 that controls the operation of each component constituting the heat source unit 2 and the utilization units 3*a*, 3*b*, and 3*c*. The control unit 8 includes a microcomputer, a memory, and the like, and is connected to each component constituting the heat source unit 2 and the utilization units 3*a*, 3*b*, and 3*c*. The refrigerant leakage sensor 6 is also connected to the control unit 8 so that the control unit 8 can acquire an electric signal concerning the refrigerant leakage in the refrigerant leakage sensor 6.

<Basic Operation>

Next, the basic operation of the refrigeration system 1 will be described with reference to FIGS. 1 and 3.

As the basic operation, the refrigeration system 1 performs a refrigeration cycle operation (cooling operation) by which the refrigerant charged into the refrigerant circuit 10 circulates through the refrigerant circuit 10.

Next, the cooling operation in the refrigerant circuit 10 will be described. The control unit 8 controls the operation of each component of the refrigeration system 1 during the cooling operation.

In the heat source unit 2, the compressor 11 compresses the low-pressure gas refrigerant until the gas refrigerant turns into high-pressure gas refrigerant. The high-pressure gas refrigerant after being compressed in the compressor 11 exchanges heat with outdoor air supplied by the heat source-side fan 22 in the heat source-side heat exchanger 12, and heat is released from the high-pressure gas refrigerant. The high-pressure liquid refrigerant, from which heat has been released in the heat source-side heat exchanger 12, is sent to the liquid-refrigerant connection pipe 4 and branched to the utilization units 3*a*, 3*b*, and 3*c*. The high-pressure liquid refrigerant sent to the utilization units 3*a*, 3*b*, and 3*c* flows into the utilization-side expansion valves 15*a*, 15*b*, and 15*c* through the inlet valves 16*a*, 16*b*, and 16*c*, respectively, and is decompressed until turning into low-pressure liquid refrigerant. The low-pressure refrigerant after being decompressed in the utilization-side expansion valves 15*a*, 15*b*, and 15*c* exchanges heat with the indoor air supplied by the utilization-side fans 31*a*, 31*b*, and 31*c* in the utilization-side heat exchangers 14*a*, 14*b*, and 14*c*, respectively, and evaporates. The low-pressure gas refrigerant after being evaporated in the utilization-side heat exchangers 14*a*, 14*b*, and 14*c* joins in the gas-refrigerant connection pipe 5 through the outlet valves 17*a*, 17*b*, and 17*c*, respectively, and is sent to the heat source unit 2. The indoor air cooled in the utilization-side heat exchangers 14*a*, 14*b*, and 14*c* is respectively sent from the utilization units 3*a*, 3*b*, and 3*c* to the air conditioning target space S to cool the air conditioning target space S. The low-pressure gas refrigerant sent to the heat source unit 2 is again compressed in the compressor 11 until turning into high-pressure gas refrigerant.

The cooling operation in the refrigeration system 1 is performed in this manner, and the air conditioning target space S is cooled.

<Operation Performed in Case Where Refrigerant Leakage is Detected>

In the refrigeration system 1, the refrigerant may leak in any of the utilization units 3*a*, 3*b*, and 3*c* due to, for example, the refrigerant pipe being broken during the cooling operation. When the refrigerant leaks in any of the utilization units 3*a*, 3*b*, and 3*c*, the leaked refrigerant accumulates in a lower part of the air conditioning target space S below the utilization units 3*a*, 3*b*, and 3*c*, and the refrigerant leakage sensor 6 detects the refrigerant leakage.

However, the refrigeration system 1 includes the plurality of (in this case, three) utilization units 3*a*, 3*b*, and 3*c* for one air conditioning target space S. Therefore, if the refrigerant leakage sensor 6 detects the refrigerant leakage, it is impossible to determine in which utilization unit the refrigerant leakage has occurred. Therefore, in a case where the refrigerant leakage sensor 6 detects the refrigerant leakage, it is necessary to stop using all the utilization units 3*a*, 3*b*, and 3*c*, that is, stop operating all the refrigerant circuit 10 corresponding to the utilization units 3*a*, 3*b*, and 3*c*, respectively. This makes it difficult to maintain the temperature of the air conditioning target space S such as a refrigeration warehouse and a freezer warehouse, in a case where it is necessary to maintain the temperature of articles stored in the air conditioning target space S.

To address this problem, here, in the case where the refrigerant leakage sensor 6 detects the refrigerant leakage, the control unit 8 performs detection standby control on the utilization units 3*a*, 3*b*, and 3*c* such that the supply of the refrigerant to the utilization-side heat exchangers 14*a*, 14*b*, and 14*c* are temporarily stopped. In a case where the refrigerant leakage is detected based on the state quantity of the refrigerant corresponding to the utilization units 3*a*, 3*b*, and 3*c* under the detection standby control, the control unit 8 stops the use of the utilization unit in which the refrigerant leakage has been detected.

Figure 4:
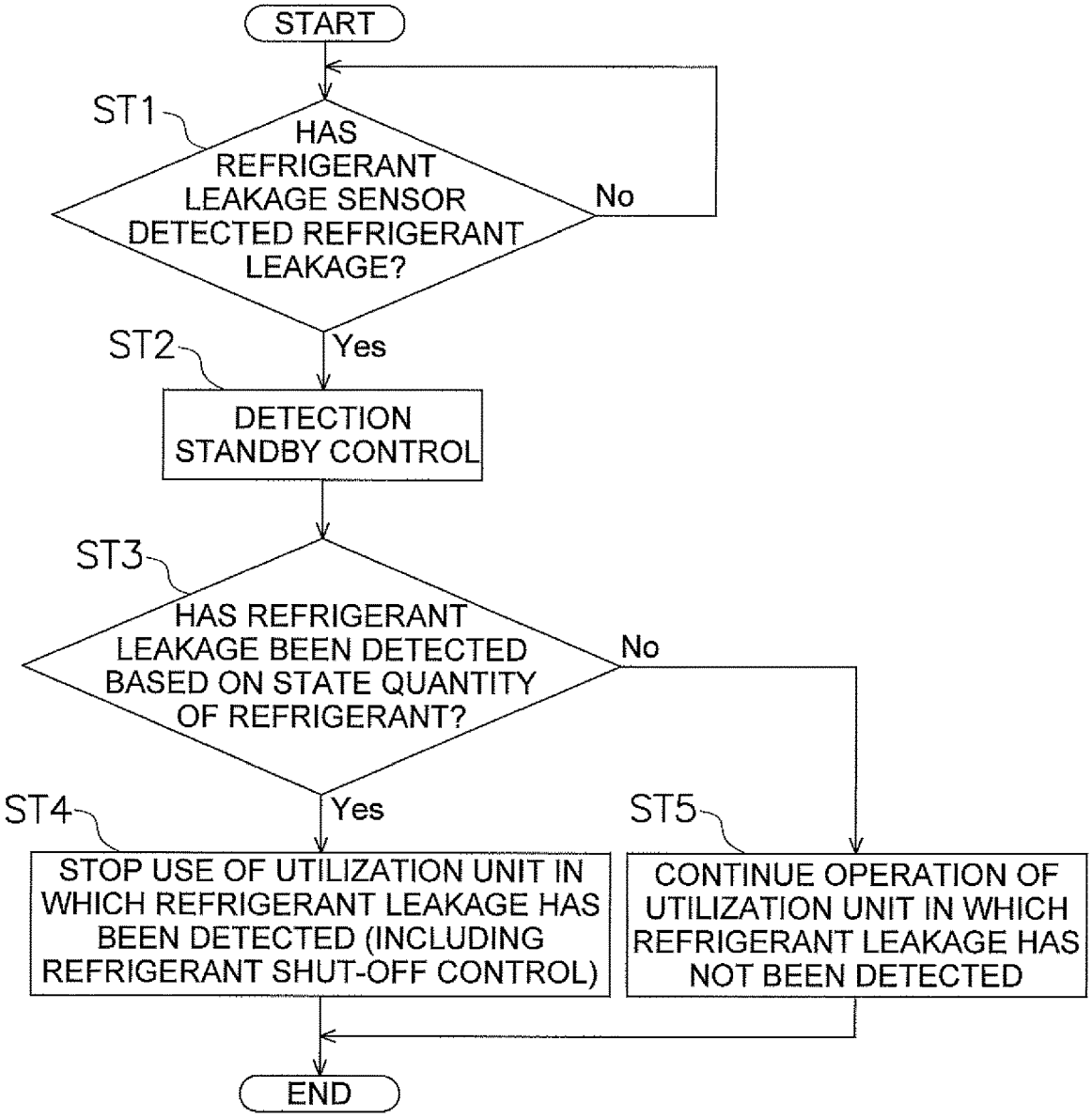
FIG. 4 is a flowchart illustrating an operation of the refrigeration system according to the first embodiment, performed in a case where a refrigerant leakage is detected.

Next, the operation of the refrigeration system 1 performed in a case where a refrigerant leakage is detected during the cooling operation will be described with reference to FIGS. 1 to 4. Here, FIG. 4 is a flowchart illustrating the operation of the refrigeration system 1 performed in the case where a refrigerant leakage is detected. The operation of the refrigeration system 1 performed in the case where a refrigerant leakage is detected, which will be described below, is also performed by the control unit 8 that controls the components of the refrigeration system 1. It is assumed in the following description that the cooling operation is performed in all the utilization units 3*a*, 3*b*, and 3*c*.

When the refrigerant leakage sensor 6 detects a leakage of the refrigerant in the air conditioning target space S provided in common for the plurality of utilization units 3*a*, 3*b*, and 3*c*, the control unit 8 acquires, from the refrigerant leakage sensor 6, an electric signal indicating detection of the refrigerant leakage in step ST1. The control unit 8 then performs processing of steps ST2 and ST3 described below in order to determine the utilization unit in which the refrigerant leakage has occurred.

In step ST2, the control unit 8 performs detection standby control on the utilization units (here, the utilization units 3*a*, 3*b*, and 3*c*) under the cooling operation such that the supply of the refrigerant to the utilization-side heat exchangers 14*a*, 14*b*, and 14*c* is temporarily stopped. Such detection standby control makes it easy to notice a change in the state quantity of the refrigerant caused by the refrigerant leakage from the utilization units 3*a*, 3*b*, and 3*c*. Here, the compressor 11 is stopped, and the inlet valves 16*a*, 16*b*, and 16*c* and the outlet valves 17*a*, 17*b*, and 17*c* provided on the refrigerant inlet side and the refrigerant outlet side, respectively, of the utilization-side heat exchangers 14*a*, 14*b*, and 14*c* are used for the detection standby control. That is, the compressor 11 is stopped, and the inlet valves 16*a*, 16*b*, and 16*c* that are opened during the cooling operation of the utilization units 3*a*, 3*b*, and 3*c* are closed during the detection standby control, whereby the supply of the refrigerant to the utilization-side heat exchangers 14*a*, 14*b*, and 14*c* can temporarily be stopped. This makes it easy to notice a change in the state quantity of the refrigerant caused by the refrigerant leakage from the utilization units 3*a*, 3*b*, and 3*c*. At this time, in the utilization units 3*a*, 3*b*, and 3*c*, the refrigerant does not flow into the sections ranging from the inlet valves 16*a*, 16*b*, and 16*c* to the outlet valves 17*a*, 17*b*, and 17*c* and including the utilization-side heat exchangers 14*a*, 14*b*, and 14*c* from the other sections of the refrigerant circuit 10. Here, since the check valves are adopted as the outlet valves 17*a*, 17*b*, and 17*c*, only the inlet valves 16*a*, 16*b*, and 16*c* need to be closed. If electromagnetic valves are adopted as the outlet valves 17*a*, 17*b*, and 17*c*, however, it is necessary to close the opened outlet valves 17*a*, 17*b*, and 17*c* together with the inlet valves 16*a*, 16*b*, and 16*c*. Here, time for the detection standby control is set to the minimum possible time (for example, 2 minutes to 20 minutes) necessary for detecting the refrigerant leakage based on the state quantity of the refrigerant in step ST3.

Next, in step ST3, the control unit 8 detects the refrigerant leakage based on the state quantity of the refrigerant corresponding to the utilization units 3*a*, 3*b*, and 3*c* under the detection standby control. Here, the refrigerant leakage is detected in a case where the state quantity of the refrigerant corresponding to the utilization units 3*a*, 3*b*, and 3*c* under the detection standby control indicates that the pressure of the refrigerant in the utilization-side heat exchangers 14*a*, 14*b*, and 14*c* is near the atmospheric pressure. In this case, in the utilization unit in which the refrigerant is leaking, the pressure of the refrigerant in the utilization-side heat exchanger decreases to approach the atmospheric pressure during the detection standby control due to the refrigerant leakage. Therefore, here, the refrigerant pressure Px detected by the pressure sensors 33*a*, 33*b*, and 33*c* of the utilization units 3*a*, 3*b*, and 3*c* is set as the state quantity of the refrigerant corresponding to the utilization units 3*a*, 3*b*, and 3*c* under the detection standby control. It is assumed that the refrigerant leakage is detected when the refrigerant pressure Px as the state quantity of the refrigerant reaches a refrigerant leakage determination pressure Pxm or less that is set based on the atmospheric pressure. In this manner, here, the utilization unit in which the refrigerant is leaking is reliably determined based on the state quantity of the refrigerant corresponding to the utilization units 3*a*, 3*b*, and 3*c* under the detection standby control. Here, the refrigerant pressure Px detected by the pressure sensors 33*a*, 33*b*, and 33*c* is adopted as the state quantity of the refrigerant for detecting the refrigerant leakage, but the state quantity is not limited to the refrigerant pressure. The control unit 8 then performs the processing of step ST4 described below in order to stop the use of the utilization unit in which the refrigerant leakage has been detected. Meanwhile, the control unit 8 performs the processing of step ST5 described below in order to continue the operation of the utilization unit in which the refrigerant leakage has not been detected.

In step ST4, the control unit 8 stops the use of the utilization unit in which the refrigerant leakage has been detected. Here, "to stop the use of the utilization unit" means to stop the cooling operation by the utilization unit in which the refrigerant leakage has been detected. For example, in a case where the refrigerant leakage is detected in the utilization unit 3*a*, the inlet valve 16*a* and the outlet valve 17*a* of the utilization unit 3*a* to be stopped are closed (that is, the inlet valve 16*a* and the outlet valve 17*a* that have been closed under the detection standby control of step ST2 remain closed). As a result, the utilization-side heat exchanger 14*a* does not function as a refrigerant evaporator, and the cooling operation by the utilization unit 3*a* is stopped. In step ST5, the control unit 8 continues the operation of the utilization unit in which the refrigerant leakage has not been detected. Here, "to continue the operation of the utilization unit" means to continue the cooling operation by the utilization unit in which the refrigerant leakage has not been detected. For example, in a case where the refrigerant leakage is not detected in the utilization units 3*b* and 3*c*, the compressor 11 is operated, and the inlet valves 16*b*, 16*c* and the outlet valves 17*b*, 17*c* that have been temporarily closed under the detection standby control of step ST2 are opened, whereby the cooling operation by the utilization units 3*b* and 3*c* is continued. As described above, according to the processing of steps ST4 and ST5, in the case where the refrigerant leakage is detected based on the state quantity of the refrigerant in the utilization units 3*a*, 3*b*, and 3*c* during the detection standby control, the use of the utilization unit in which the refrigerant leakage has been detected is stopped. This makes it possible to suppress the refrigerant leakage from the utilization unit, in which the refrigerant is leaking, to the air conditioning target space S, and to continue the operation of the utilization unit in which the refrigerant is not leaking.

As a result, here, the refrigeration system 1 provided with the plurality of utilization units 3*a*, 3*b*, and 3*c* for one air conditioning target space S can reliably determine the utilization unit in which the refrigerant is leaking and stop the use of that utilization unit. This makes it possible to minimize the refrigerant leakage to the air conditioning target space S and to continue the operation of the utilization unit in which the refrigerant is not leaking, thereby maintaining the temperature of the air conditioning target space S as much as possible.

In addition, here, the inlet valve 16*a* of the utilization unit 3*a* to be stopped is closed in step ST4, making it possible to shut off the flow of the refrigerant from the liquid-refrigerant connection pipe 4 into the utilization-side heat exchanger 14*a* while at the same time shutting off, with the outlet valve 17*a*, the flow of the refrigerant from the gas-refrigerant connection pipe 5 into the utilization-side heat exchanger 14*a*. That is, here, when the use of the utilization unit 3*a* in which the refrigerant leakage has been detected is stopped in step ST4, refrigerant shut-off control is also performed in which the inlet valve 16*a* and the outlet valve 17*a* corresponding to the utilization-side heat exchanger 14*a* of the utilization unit 3*a* to be stopped are used to shut off the flow of the refrigerant into the utilization-side heat exchanger 14*a*.

Here, the refrigerant shut-off control is performed in this manner at the time of stopping the use of the utilization unit in which the refrigerant leakage has been detected. As a result, the section between the inlet valve and the outlet valve in the utilization unit to be stopped can be separated from the other section of the refrigerant circuit 10. This makes it possible to further reduce the amount of refrigerant leaking from the utilization unit to be stopped to the air conditioning target space S. Furthermore, in this case, the outlet valves 17*a*, 17*b*, and 17*c* are check valves. Therefore, in a case where the pressure of the refrigerant in the section between the inlet valve and the outlet valve in the utilization unit to be stopped is higher than the pressure of the refrigerant in the gas-refrigerant connection pipe 5, it is possible to return the former refrigerant to the section of the refrigerant circuit 10 that is under operation.

<First Modification>

The refrigerant leakage sensor 6 may erroneously detect flammable gas different from the refrigerant. For example, in a refrigeration warehouse or a freezer warehouse, foods are stored as articles in the air conditioning target space S, and thus ethylene gas or the like may be generated. The refrigerant leakage sensor 6 may erroneously detect such flammable gas.

Figure 5:
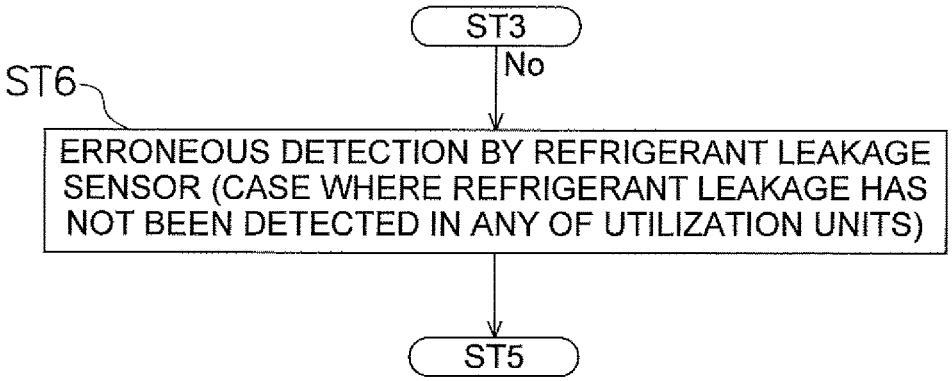
FIG. 5 is a main part of a flowchart illustrating an operation of a refrigeration system according to a first modification of the first embodiment, performed in a case where a refrigerant leakage is detected.

Therefore, here, the processing of step ST6 illustrated in FIG. 5 is performed in a case where the refrigerant leakage in the air conditioning target space S has been detected through the processing of step ST1 but the refrigerant leakage has not been detected in any of the utilization units 3*a* to 3*c* through the processing of step ST3. More specifically, in the case where the refrigerant leakage has not been detected in any of the utilization units 3*a* to 3*c* through the processing of step ST3, not only do all the utilization units 3*a* to 3*c* continue the operation through the processing of step ST5, but also the erroneous detection by the refrigerant leakage sensor 6 is determined in step ST6. The operation of the refrigeration system 1 including step ST6 is also performed by the control unit 8 that controls the components of the refrigeration system 1.

As described above, here, in the case where the refrigerant leakage sensor 6 has detected the refrigerant leakage in the air conditioning target space S but has not detected the refrigerant leakage in any of the utilization units 3*a* to 3*c* during the detection standby control, it can be determined that the refrigerant leakage sensor 6 has erroneously detected, for example, other flammable gas other than the refrigerant.

<Second Modification>

For example, the above processing of steps ST2 to ST5, in the operation performed in the case where the refrigerant leakage has been detected, may be performed simultaneously for all the utilization units 3*a*, 3*b*, and 3*c*, or sequentially for the utilization units 3*a*, 3*b*, and 3*c*.

(2) Second Embodiment

In the refrigeration system 1 according to the first embodiment, as illustrated in FIG. 1, the plurality of utilization units 3*a*, 3*b*, and 3*c* is provided for one air conditioning target space S, and the heat source unit 2 is connected in common to the plurality of utilization units 3*a*, 3*b*, and 3*c* to thereby constitute the refrigerant circuit 10. In other words, the refrigeration system 1 according to the first embodiment includes the refrigerant circuit 10 that is provided in common for the utilization units 3*a*, 3*b*, and 3*c*. However, the configuration of the refrigeration system 1 is not limited to this. Alternatively, as will be described below, the refrigeration system 1 may include refrigerant circuits 10*a*, 10*b*, and 10*c* for the utilization units 3*a*, 3*b*, and 3*c*, respectively.

<Configuration>

Figure 6:
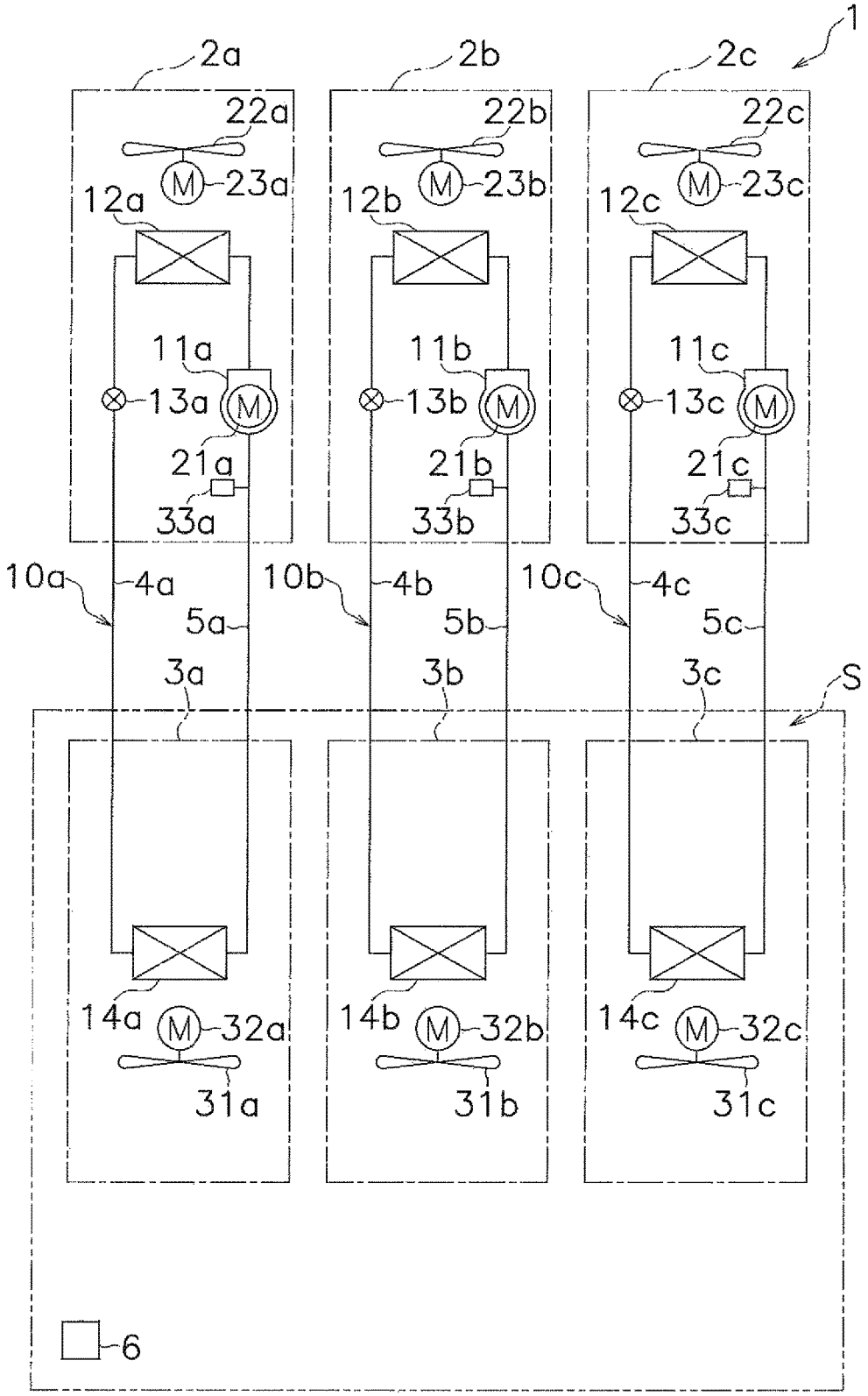
FIG. 6 is a schematic configuration diagram of the refrigeration system according to the second embodiment of the present invention.

FIG. 6 is a schematic configuration diagram of a refrigeration system 1 according to a second embodiment of the present invention. The refrigeration system 1 has a plurality of (in this case, three) utilization units 3*a*, 3*b*, and 3*c* provided for one air conditioning target space S such as a large refrigeration warehouse or freezer warehouse. As illustrated in FIG. 2, the utilization units 3*a*, 3*b*, and 3*c* are disposed at an upper part of the air conditioning target space S. The number of utilization units is not limited to three, and just needs to be two or more. Alternatively, the utilization units 3*a*, 3*b*, and 3*c* may be disposed above the air conditioning target space S.

Here, the refrigeration system 1 includes a plurality of (in this case, three) heat source units 2*a*, 2*b*, and 2*c* provided corresponding to the utilization units 3*a*, 3*b*, and 3*c*, respectively. As illustrated in FIG. 6, the heat source units 2*a*, 2*b*, and 2*c* are disposed outside the air conditioning target space S. The heat source units 2*a*, 2*b*, and 2*c* are respectively connected to the corresponding utilization units 3*a*, 3*b*, and 3*c* to thereby constitute the refrigerant circuits 10*a*, 10*b*, and 10*c* through which a refrigerant circulates. Here, the utilization unit 3*a* constitutes the refrigerant circuit 10*a* by being connected to the heat source unit 2*a* via a liquid-refrigerant connection pipe 4*a* and a gas-refrigerant connection pipe 5*a*. The utilization unit 3*b* constitutes the refrigerant circuit 10*b* by being connected to the heat source unit 2*b* via a liquid-refrigerant connection pipe 4*b* and a gas-refrigerant connection pipe 5*b*. The utilization unit 3*c* constitutes the refrigerant circuit 10*c* by being connected to the heat source unit 2*c* via a liquid-refrigerant connection pipe 4*c* and a gas-refrigerant connection pipe 5*c*. That is, here, the refrigerant circuits 10*a*, 10*b*, and 10*c* are provided for the utilization units 3*a*, 3*b*, and 3*c*, respectively, as described above. The refrigerant circuits 10*a*, 10*b*, and 10*c* are filled with the refrigerant. In this case, the refrigerant used is R32, which is one kind of flammable refrigerant. The refrigerant to be charged into the refrigerant circuits 10*a*, 10*b*, and 10*c* is not limited to R32 but may be other flammable refrigerant such as propane.

Next, the refrigerant circuits 10*a*, 10*b*, and 10*c* and peripheral configurations thereof will be described. In the following description, the refrigerant circuit 10*a* and the peripheral configuration thereof will be described. The description of the refrigerant circuits 10*b* and 10*c* and the peripheral configurations thereof is omitted, since the suffix "a" just needs to be replaced with "b" or "c" for that matter.

The refrigerant circuit 10*a* mainly includes a compressor 11*a*, a heat source-side heat exchanger 12*a*, a heat source-side expansion valve 13*a*, a utilization-side heat exchanger 14*a*, and refrigerant pipes (including the refrigerant connection pipes 4*a* and 5*a*) that connect these devices.

The compressor 11*a* is a device that is provided in the heat source unit 2*a* and compresses low-pressure gas refrigerant until the gas refrigerant turns into high-pressure gas refrigerant. The compressor 11*a* is driven by a compressor motor 21*a*.

The heat source-side heat exchanger 12*a* is a device that is provided in the heat source unit 2*a* and exchanges heat between the high-pressure gas refrigerant after being compressed in the compressor 11*a* and air outside the air conditioning target space S (outdoor air). That is, the heat source-side heat exchanger 12*a* functions as a refrigerant radiator that releases heat from the high-pressure gas refrigerant using outdoor air as a cooling source. A heat source-side fan 22*a* supplies the outdoor air to the heat source-side heat exchanger 12*a*. The heat source-side fan 22*a* is provided in the heat source unit 2*a*. The heat source-side fan 22*a* is driven by a heat source-side fan motor 23*a*. Here, an air-cooled radiator using the outdoor air as a cooling source is adopted as the heat source-side heat exchanger 12*a*, but the heat exchanger is not limited to such a radiator. Alternatively, a water-cooled radiator using water as a cooling source may be used.

The heat source-side expansion valve 13*a* is a device that is provided in the heat source unit 2*a* and decompresses the high-pressure liquid refrigerant, from which heat has been released in the heat source-side heat exchanger 12*a*, until the liquid refrigerant turns into low-pressure liquid refrigerant. In this case, an electric expansion valve, the opening degree of which is controllable, is adopted as the heat source-side expansion valve 13*a*, but the expansion valve is not limited to such a valve.

A pressure sensor 33*a* is a device that is provided in the heat source unit 2*a* and detects a refrigerant pressure Ps on the intake side of the compressor 11*a*.

In this manner, the heat source unit 2*a* is mainly provided with the compressor 11*a*, the heat source-side heat exchanger 12*a*, the heat source-side expansion valve 13*a*, and the pressure sensor 33*a*. The heat source unit 2*a* functions as a condensing unit that converts low-pressure gas refrigerant into high-pressure liquid refrigerant.

The utilization-side heat exchanger 14*a* is a device that is provided in the utilization unit 3*a* and exchanges heat between the low-pressure refrigerant after being decompressed in the heat source-side expansion valve 13*a* and air inside the air conditioning target space S (indoor air). That is, the utilization-side heat exchanger 14*a* functions as a refrigerant evaporator that evaporates the low-pressure refrigerant using the indoor air as a heating source. A utilization-side fan 31*a* supplies the indoor air to the utilization-side heat exchanger 14*a*. In other words, the utilization-side fan 31*a* is provided as a device that sends, to the air conditioning target space S, the indoor air with which heat has been exchanged in the utilization-side heat exchanger 14*a*. The utilization-side fan 31*a* is provided in the utilization unit 3*a*. The utilization-side fan 31*a* is driven by a utilization-side fan motor 32*a*.

In this manner, the utilization unit 3*a* is mainly provided with the utilization-side heat exchanger 14*a* and the utilization-side fan 31*a*. The utilization unit 3*a* functions as a blower coil unit that cools the indoor air by evaporating the low-pressure refrigerant and sends the indoor air to the air conditioning target space S.

The refrigeration system 1 is also provided with a refrigerant leakage sensor 6 that detects a leakage of the refrigerant, as a safety measure against use of flammable refrigerant such as R32. The flammable refrigerant such as R32 is heavier than air. Therefore, when the refrigerant leaks in the utilization units 3*a*, 3*b*, and 3*c*, the leaked refrigerant tends to accumulate in a lower part of the air conditioning target space S below the utilization units 3*a*, 3*b*, and 3*c*. In consideration of this, the refrigerant leakage sensor 6 is provided in a lower part of the air conditioning target space S as illustrated in FIG. 2.

Figure 7:
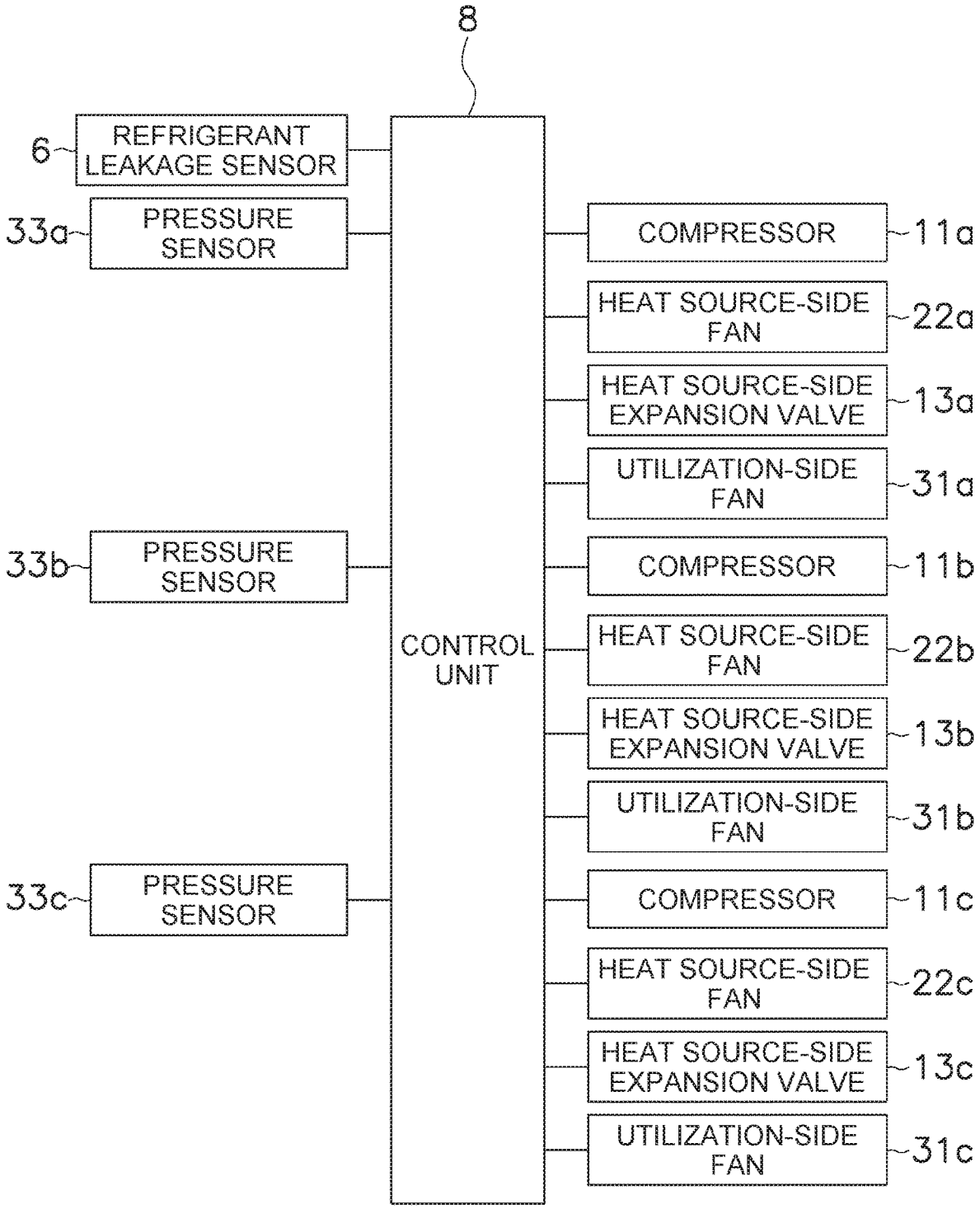
FIG. 7 is a control block diagram of the refrigeration system according to the second embodiment.

As illustrated in FIG. 7, the refrigeration system 1 is also provided with a control unit 8 that controls the operation of each component constituting the heat source units 2*a*, 2*b*, and 2*c* and the utilization units 3*a*, 3*b*, and 3*c*. The control unit 8 includes a microcomputer, a memory, and the like, and is connected to each component constituting the heat source units 2*a*, 2*b*, and 2*c* and the utilization units 3*a*, 3*b*, and 3*c*. The refrigerant leakage sensor 6 is also connected to the control unit 8 so that the control unit 8 can acquire an electric signal concerning the refrigerant leakage in the refrigerant leakage sensor 6.

<Basic Operation>

Next, the basic operation of the refrigeration system 1 will be described with reference to FIGS. 6 and 7.

As the basic operation, the refrigeration system 1 performs a refrigeration cycle operation (cooling operation) by which the refrigerant charged into the refrigerant circuits 10*a*, 10*b*, and 10*c* circulates through the refrigerant circuits 10*a*, 10*b*, and 10*c*.

Next, the cooling operation in the refrigerant circuits 10*a*, 10*b*, and 10*c* will be described. In the following description, the cooling operation in the refrigerant circuit 10*a* will be described. The description of the cooling operations in the refrigerant circuits 10*b* and 10*c* is omitted, since the suffix "a" just needs to be replaced with "b" or "c" for that matter. The control unit 8 controls the operation of each component of the refrigeration system 1 during the cooling operation.

In the heat source unit 2*a*, the compressor 11*a* compresses the low-pressure gas refrigerant until the gas refrigerant turns into high-pressure gas refrigerant. The high-pressure gas refrigerant after being compressed in the compressor 11*a* exchanges heat with outdoor air supplied by the heat source-side fan 22*a* in the heat source-side heat exchanger 12*a*, and heat is released from the high-pressure gas refrigerant. The high-pressure liquid refrigerant, from which heat has been released in the heat source-side heat exchanger 12*a*, flows into the heat source-side expansion valve 13*a* and is decompressed until turning into low-pressure liquid refrigerant. The low-pressure refrigerant after being decompressed in the heat source-side expansion valve 13*a* is sent to the utilization unit 3*a* through the liquid-refrigerant connection pipe 4*a*. The low-pressure refrigerant sent to utilization unit 3*a* exchanges heat with the indoor air supplied by the utilization-side fan 31*a* in the utilization-side heat exchanger 14*a*, and evaporates. The low-pressure gas refrigerant after being evaporated in the utilization-side heat exchanger 14*a* is sent to the heat source unit 2*a* through the gas-refrigerant connection pipe 5*a*. The indoor air cooled in the utilization-side heat exchanger 14*a* is sent from the utilization unit 3*a* to the air conditioning target space S to cool the air conditioning target space S. The low-pressure gas refrigerant sent to the heat source unit 2*a* is again compressed in the compressor 11*a* until turning into high-pressure gas refrigerant.

The cooling operation in the refrigeration system 1 is performed in this manner, and the air conditioning target space S is cooled.

<Operation Performed in Case Where Refrigerant Leakage is Detected>

Also in the refrigeration system 1 of the present embodiment, similarly to the first embodiment, the refrigerant leakage sensor 6 detects a refrigerant leakage that occurs in any of the utilization units 3*a*, 3*b*, and 3*c* due to, for example, the refrigerant pipe being broken during the above-mentioned cooling operation.

However, the refrigeration system 1 of the present embodiment also includes the plurality of (in this case, three) utilization units 3*a*, 3*b*, and 3*c* for one air conditioning target space S. Therefore, the refrigerant leakage sensor 6 cannot determine in which utilization unit the refrigerant leakage has occurred, as in the first embodiment. This makes it difficult to maintain the temperature of the air conditioning target space S such as a refrigeration warehouse and a freezer warehouse, in a case where it is necessary to maintain the temperature of articles stored in the air conditioning target space S.

To address this problem, similarly to the first embodiment, in the case where the refrigerant leakage sensor 6 detects the refrigerant leakage, the control unit 8 performs detection standby control on the utilization units 3*a*, 3*b*, and 3*c* such that the supply of the refrigerant to the utilization-side heat exchangers 14*a*, 14*b* and 14*c* are temporarily stopped. In a case where the refrigerant leakage is detected based on the state quantity of the refrigerant corresponding to the utilization units 3*a*, 3*b*, and 3*c* under the detection standby control, the control unit 8 stops the use of the utilization unit in which the refrigerant leakage has been detected.

Figure 8:
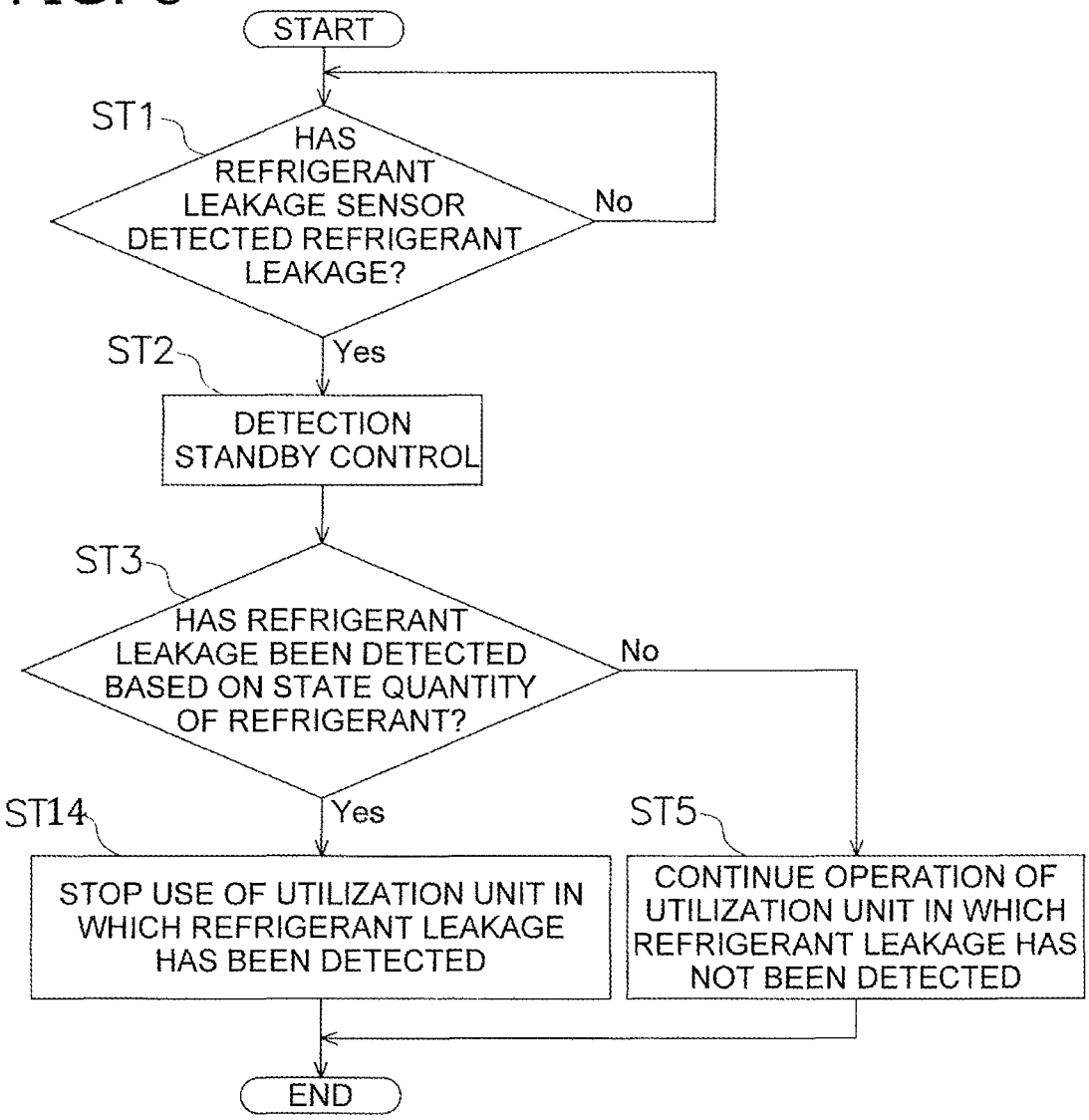
FIG. 8 is a flowchart illustrating an operation of the refrigeration system according to the second embodiment, performed in a case where a refrigerant leakage is detected.

Next, the operation of the refrigeration system 1 performed in a case where a refrigerant leakage is detected during the cooling operation will be described with reference to FIGS. 2 and 6 to 8. Here, FIG. 8 is a flowchart illustrating the operation of the refrigeration system 1 performed in the case where a refrigerant leakage is detected. The operation of the refrigeration system 1 performed in the case where a refrigerant leakage is detected, which will be described below, is also performed by the control unit 8 that controls the components of the refrigeration system 1. It is assumed in the following description that the cooling operation is performed in all the utilization units 3*a*, 3*b*, and 3*c*.

When the refrigerant leakage sensor 6 detects a leakage of the refrigerant in the air conditioning target space S provided in common for the plurality of utilization units 3*a*, 3*b*, and 3*c*, the control unit 8 acquires, from the refrigerant leakage sensor 6, an electric signal indicating detection of the refrigerant leakage in step ST1, as in the first embodiment. The control unit 8 then performs processing of steps ST2 and ST3 described below in order to determine the utilization unit in which the refrigerant leakage has occurred.

In step ST2, the control unit 8 performs detection standby control on the utilization units (here, the utilization units 3*a*, 3*b*, and 3*c*) under the cooling operation such that the supply of the refrigerant to the utilization-side heat exchangers 14*a*, 14*b*, and 14*c* is temporarily stopped. Such detection standby control makes it easy to notice a change in the state quantity of the refrigerant caused by the refrigerant leakage from the utilization units 3*a*, 3*b*, and 3*c*. In this case, the compressors 11*a*, 11*b*, and 11*c* are stopped, and the detection standby control is performed using the heat source-side expansion valves 13*a*, 13*b*, and 13*c*. That is, the compressors 11*a*, 11*b*, and 11*c* are stopped, and the heat source-side expansion valves 13*a*, 13*b*, and 13*c* that are opened during the cooling operation of the utilization units 3*a*, 3*b*, and 3*c* are closed during the detection standby control, whereby the supply of the refrigerant to the utilization-side heat exchangers 14*a*, 14*b*, and 14*c* can temporarily be stopped. This makes it easy to notice a change in the state quantity of the refrigerant caused by the refrigerant leakage from the utilization units 3*a*, 3*b*, and 3*c*. At this time, if the refrigerant leaks from the utilization units 3*a*, 3*b*, and 3*c*, the pressure of the refrigerant is lowered in low-pressure sections of the refrigerant circuits 10*a*, 10*b*, and 10*c* constituted by the utilization units 3*a*, 3*b*, and 3*c* (sections ranging from the heat source-side expansion valves 13*a*, 13*b*, and 13*c* to the compressors 11*a*, 11*b*, and 11*c* and including the utilization units 3*a*, 3*b*, and 3*c* in between). Here, time for the detection standby control is set to the minimum possible time (for example, 2 minutes to 20 minutes) necessary for detecting the refrigerant leakage based on the state quantity of the refrigerant in step ST3.

Next, in step ST3, the control unit 8 detects the refrigerant leakage based on the state quantity of the refrigerant corresponding to the utilization units 3*a*, 3*b*, and 3*c* under the detection standby control. Here, the refrigerant leakage is detected in a case where the state quantity of the refrigerant corresponding to the utilization units 3*a*, 3*b*, and 3*c* under the detection standby control indicates that the refrigerant circuits 10*a*, 10*b*, and 10*c* constituted by the utilization units 3*a*, 3*b*, and 3*c* have run out of gas. In this case, in the utilization unit in which the refrigerant is leaking, the pressure of the refrigerant in the low-pressure section of the refrigerant circuit decreases due to the refrigerant leakage during the detection standby control and the refrigerant circuit runs out of gas. Therefore, here, the refrigerant pressure Ps detected by the pressure sensors 33*a*, 33*b*, and 33*c* of the heat source units 2*a*, 2*b*, and 2*c* is set as the state quantity of the refrigerant corresponding to the utilization units 3*a*, 3*b*, and 3*c* under the detection standby control. It is assumed that the refrigerant leakage is detected when the refrigerant pressure Ps as the state quantity of the refrigerant reaches a refrigerant leakage determination pressure Psm or less that indicates that the refrigerant circuit has run out of gas. In this manner, here, the utilization unit in which the refrigerant is leaking is reliably determined based on the state quantity of the refrigerant corresponding to the utilization units 3*a*, 3*b*, and 3*c* under the detection standby control. Here, the refrigerant pressure Ps detected by the pressure sensors 33*a*, 33*b*, and 33*c* is adopted as the state quantity of the refrigerant for detecting the refrigerant leakage, but the state quantity is not limited to the refrigerant pressure. The control unit 8 then performs the processing of step ST14 described below in order to stop the use of the utilization unit in which the refrigerant leakage has been detected. Meanwhile, the control unit 8 performs the processing of step ST5 described below in order to continue the operation of the utilization unit in which the refrigerant leakage has not been detected.

In step ST14, the control unit 8 stops the use of the utilization unit in which the refrigerant leakage has been detected. Here, "to stop the use of the utilization unit" means to stop the cooling operation by the refrigerant circuit corresponding to the utilization unit in which the refrigerant leakage has been detected. For example, in a case where the refrigerant leakage is detected in the utilization unit 3*a*, the operation of the compressor 11*a* is stopped and the heat source-side expansion valve 13*a* is closed (that is, the compressor 11*a* that has been stopped under the detection standby control of step ST2 remains stopped, and the heat source-side expansion valve 13*a* that has been closed under the detection standby control of step ST2 remains closed). As a result, the cooling operation by the refrigerant circuit 10*a* corresponding to the utilization unit 3*a* is stopped. In step ST5, the control unit 8 continues the operation of the utilization unit in which the refrigerant leakage has not been detected. Here, "to continue the operation of the utilization unit" means to continue the cooling operation by the utilization unit in which the refrigerant leakage has not been detected. For example, in a case where the refrigerant leakage is not detected in the utilization units 3*b* and 3*c*, the operation of the compressors 11*b* and 11*c* that have been temporarily stopped under the detection standby control of step ST2 is restarted, and the heat source-side expansion valves 13*b* and 13*c* that have been temporarily closed under the detection standby control of step ST2 are opened. This enables the refrigerant circuits 10*b* and 10*c* corresponding to the utilization units 3*b* and 3*c* to continue the cooling operation. As described above, according to the processing of steps ST14 and ST5, in the case where the refrigerant leakage is detected based on the state quantity of the refrigerant in the utilization units 3*a*, 3*b*, and 3*c* during the detection standby control, the use of the utilization unit in which the refrigerant leakage has been detected is stopped. This makes it possible to suppress the refrigerant leakage from the utilization unit, in which the refrigerant is leaking, to the air conditioning target space S, and to continue the operation of the utilization unit in which the refrigerant is not leaking.

As a result, here, the refrigeration system 1 provided with the plurality of utilization units 3*a*, 3*b*, and 3*c* for one air conditioning target space S can reliably determine the utilization unit in which the refrigerant is leaking and stop the use of that utilization unit. This makes it possible to minimize the refrigerant leakage to the air conditioning target space S and to continue the operation of the utilization unit in which the refrigerant is not leaking, thereby maintaining the temperature of the air conditioning target space S as much as possible.

<First Modification>

Some refrigerant may remain in the utilization-side heat exchanger or the refrigerant pipe and the like of the utilization unit in which the refrigerant has leaked, even after the use of that utilization unit is stopped through the processing of step ST14 in the operation performed in the case where the refrigerant leakage has been detected. For this reason, the refrigerant may leak from the utilization unit, the use of which has been stopped through the processing of step ST14, to the air conditioning target space S.

Figure 9:
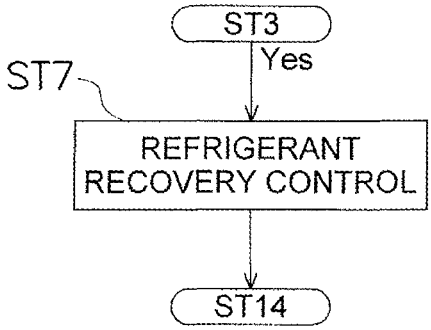
FIG. 9 is a main part of a flowchart illustrating an operation of a refrigeration system according to a first modification of the second embodiment, performed in a case where a refrigerant leakage is detected.

Therefore, here, in the case where there is the utilization unit in which the refrigerant leakage has been detected through the processing of step ST3, the processing of step ST7 illustrated in FIG. 9 is performed at the time of performing the processing of step ST14. More specifically, when the use of the utilization unit in which the refrigerant leakage has been detected is stopped in step ST14, refrigerant recovery control is performed in step ST7 to cause the heat source unit, which is connected to the utilization unit to be stopped, to recover the refrigerant. For example, in a case where the utilization unit 3*a* is to be stopped, prior to step ST14, the compressor 11*a* is temporarily operated with the heat source-side expansion valve 13*a* closed, and the refrigerant present in the utilization unit 3*a* is recovered to the heat source unit 2*a*. After the refrigerant recovery control in step ST7, the processing of step ST14 (in which the operation of the compressor 11*a* is stopped) is performed. The operation of the refrigeration system 1 including step ST7 is also performed by the control unit 8 that controls the components of the refrigeration system 1.

Here, the refrigerant recovery control is performed in this manner at the time of stopping the use of the utilization unit in which the refrigerant leakage has been detected. It is thus possible to reduce the amount of refrigerant present in the utilization unit to be stopped. This makes it possible to further reduce the amount of refrigerant leaking from the utilization unit to be stopped to the air conditioning target space S.

<Second Modification>

Also in this case, the refrigerant leakage sensor 6 may erroneously detect gas as in the configuration of the first embodiment. Therefore, also in this case, the processing similar to that of the first modification of the first embodiment (processing of step ST6 illustrated in FIG. 5) may be performed in a case where the refrigerant leakage in the air conditioning target space S has been detected through the processing of step ST1 but the refrigerant leakage has not been detected in any of the utilization units 3*a* to 3*c* through the processing of step ST3. More specifically, in the case where the refrigerant leakage has not been detected in any of the utilization units 3*a* to 3*c* through the processing of step ST3, not only do all the utilization units 3*a* to 3*c* continue the operation through the processing of step ST5, but also the erroneous detection by the refrigerant leakage sensor 6 is determined in step ST6.

As described above, also in this case, if the refrigerant leakage sensor 6 has detected the refrigerant leakage in the air conditioning target space S but has not detected the refrigerant leakage in any of the utilization units 3*a* to 3*c* during the detection standby control, it can be determined that the refrigerant leakage sensor 6 has erroneously detected, for example, other flammable gas other than the refrigerant.

<Third Modification>

Furthermore, also in this case, the above processing of steps ST2, ST3, ST14, and ST5, in the operation performed in the case where the refrigerant leakage has been detected, may be performed simultaneously for all the utilization units 3*a*, 3*b*, and 3*c*, or sequentially for the utilization units 3*a*, 3*b*, and 3*c* as in the second modification of the first embodiment.

INDUSTRIAL APPLICABILITY

The present invention is widely applicable to a refrigeration system provided with a plurality of utilization units for one air conditioning target space.

REFERENCE SIGNS LIST

1 Refrigeration system
2, 2*a*, 2*b*, 2*c* Heat source unit
3*a*, 3*b*, 3*c* Utilization unit
6 Refrigerant leakage sensor
8 Control unit
10, 10*a*, 10*b*, 10*c* Refrigerant circuit
14*a*, 14*b*, 14*c* Utilization-side heat exchanger
16*a*, 16*b*, 16*c* Inlet valve
17*a*, 17*b*, 17*c* Outlet valve

CITATION LIST

Patent Literature

[Patent Literature 1] JP 2013-40694 A
[Patent Literature 2] JP 4639451 B2

The invention claimed is:

1. A refrigeration system comprising:

a plurality of utilization units provided for one air conditioning target space and each utilization unit including a corresponding utilization-side heat exchanger configured to exchange heat between a refrigerant and air;

a refrigerant leakage sensor configured to detect leakage of the refrigerant in the air conditioning target space; and a control unit including a processor configured to perform, in response to detection of a refrigerant leak by the refrigerant leakage sensor, detection standby control on each of the utilization units such that supply of the refrigerant to the corresponding utilization-side heat exchanger in each of the plurality of utilization units is temporarily stopped, determine, based on a measured state of the refrigerant in each of the corresponding utilization units under the detection standby control, whether any of the plurality of utilization units has a leak, and stop use of any utilization unit determined to have a refrigerant leak and resume operations in the utilization units determined to not have a refrigerant leak or if none of the utilization units are determined to have refrigerant leakage resume operations in all of the utilization units and indicate an erroneous leak detection.

2. The refrigeration system according to claim 1, further comprising a plurality of heat source units, each of the plurality of heat source units corresponding to a respective one of the plurality of utilization units, wherein each heat source unit constitutes a refrigerant circuit through which the refrigerant circulates, by being connected to the corresponding utilization unit.

3. The refrigeration system according to claim 2, wherein the control unit determines that a utilization unit under the detection standby control has a refrigerant leakage in a case where the refrigerant pressure of its corresponding utilization-side heat exchanger indicates that the refrigerant circuit constituted by the utilization unit is in a depressurized state.

4. The refrigeration system according to claim 2, wherein when the control unit stops use of the utilization unit determined to have a refrigerant leakage, the control unit performs refrigerant recovery control for causing the heat source unit corresponding to the utilization unit to be stopped to recover the refrigerant.

5. The refrigeration system according to claim 1, further comprising a heat source unit that is provided in common for the plurality of utilization units and constitutes a refrigerant circuit through which the refrigerant circulates by being connected to the plurality of utilization units.

6. The refrigeration system according to claim 5, further comprising an inlet valve and an outlet valve provided on a refrigerant inlet side and a refrigerant outlet side, respectively, of each of the utilization-side heat exchangers, wherein the control unit performs the detection standby control using the inlet valve and the outlet valve of each utilization-side heat exchanger.

7. The refrigeration system according to claim 6, wherein the control unit determines that a utilization unit under the detection standby control has a refrigerant leakage in a case where a pressure of the refrigerant in its corresponding utilization-side heat exchanger is near an atmospheric pressure.

8. The refrigeration system according to claim 6, wherein when the control unit stops use of the utilization unit determined to have a refrigerant leakage, the control unit performs refrigerant shut-off control for shutting off flow of the refrigerant to the utilization-side heat exchanger of the utilization unit to be stopped using the inlet valve and the outlet valve corresponding to that the corresponding utilization-side heat exchanger of the utilization unit to be stopped.

9. The refrigeration system according to claim 3, wherein when the control unit stops use of the utilization unit determined to have a refrigerant leakage, the control unit performs refrigerant recovery control for causing the heat source unit corresponding to the utilization unit to be stopped to recover the refrigerant.

10. The refrigeration system according to claim 7, wherein when the control unit stops use of the utilization unit determined to have a refrigerant leakage, the control unit performs refrigerant shut-off control for shutting off flow of the refrigerant to the utilization-side heat exchanger of the utilization unit to be stopped using the inlet valve and the outlet valve corresponding to the corresponding utilization-side heat exchanger of the utilization unit to be stopped.

* * * * *